United States Patent [19]

Grüner et al.

[11] Patent Number: 5,042,375

[45] Date of Patent: Aug. 27, 1991

[54] DEVICE FOR TEMPERATURE CONTROL OF A PRINT HEAD OR OF A HAMMER BLOCK INCLUDING AN ELECTROMAGNETIC COIL

[75] Inventors: Manfred Grüner, Ulm; Christian Vogelmann, Neu-Ulm, both of Fed. Rep. of Germany

[73] Assignee: Mannesmann Aktiengesellschaft, Düsseldorf, Fed. Rep. of Germany

[21] Appl. No.: 515,103

[22] Filed: Apr. 27, 1990

[30] Foreign Application Priority Data

Apr. 27, 1989 [DE] Fed. Rep. of Germany ..... 3914275

[51] Int. Cl.[5] ..... B41J 3/00

[52] U.S. Cl. ..... 101/93.01; 101/93.05; 400/719; 400/124; 318/471

[58] Field of Search ..... 400/157.2, 157.3, 124, 400/124 TC, 54, 719, 470; 101/93.05; 346/76 PH; 318/471

[56] References Cited

U.S. PATENT DOCUMENTS

| | | | |
|---|---|---|---|
| 4,496,824 | 1/1985 | Kawai et al. | 346/76 PH |
| 4,639,650 | 1/1987 | Nakai | 400/719 |
| 4,776,712 | 10/1988 | Okuno et al. | 101/93.05 |
| 4,834,562 | 5/1989 | Shikanai et al. | 101/93.05 |
| 4,842,431 | 6/1989 | Katsukawa | 400/719 |

FOREIGN PATENT DOCUMENTS

| | | | |
|---|---|---|---|
| 0173578 | 3/1986 | European Pat. Off. | 400/124 TC |
| 0038277 | 4/1981 | Japan | 400/157.3 |
| 0117668 | 9/1981 | Japan | 101/93.05 |
| 0162672 | 12/1981 | Japan | 400/124 TC |
| 0116170 | 7/1983 | Japan | 101/93.05 |
| 0155964 | 9/1983 | Japan | 400/124 TC |
| 0115477 | 6/1985 | Japan | 400/124 TC |
| 0202752 | 9/1987 | Japan | 401/93.05 |
| 0263068 | 11/1987 | Japan | 400/124 TC |
| 0134256 | 6/1988 | Japan | 101/93.05 |
| 0199655 | 8/1988 | Japan | 400/124 TC |

*Primary Examiner*—Eugene H. Eickholt
*Attorney, Agent, or Firm*—Horst M. Kasper

[57] ABSTRACT

A switching signal, either for the switching off of the print head (20), or for a lowering of the operating frequency, or for a switching-on/switching-off control of a blower motor, is employed in connection with an installation of a temperature surveillance of a print head (20) or of a hammer block based on an electromagnetic coil construction. In order to achieve a more precise, a quicker and a more individual measurement determination, the electromagnetic coil (3), coordinated to each print element (1), is in each case switched during a current-passing pause to a primary constant current source generating a voltage ($U_p$). A coil voltage drop ($U_s$) at the electromagnetic coil (3) generates a reference signal (26) at the comparator (27) setting the temperature limit. The reference voltage ($U_{ref}$) is received as a binary logic signal in an intermediate data memory storage (30). The logic signal serves as a control signal for effecting a temperature limiting or a temperature lowering in the print head (20).

20 Claims, 2 Drawing Sheets

DEVICE FOR TEMPERATURE CONTROL OF A PRINT HEAD OR OF A HAMMER BLOCK INCLUDING AN ELECTROMAGNETIC COIL

BACKGROUND OF THE INVENTION

1. Field of the Invention

The invention relates to a device for the temperature surveillance of a print head or of a hammer block constructed with an electromagnetic coil and which is used in particular for serial matrix pin printers.

2. Description of the Background of the Invention Including Prior Art

A print head or a hammer block constructed with an electromagnetic coil represents an interface between the mechanics of a matrix printer and the electronics of the print-head control. The demands for higher and higher print speeds and device lifetimes result in an extreme mechanical and electrical load onto the print head. These requirements result in that the print head becomes one of the most expensive device components in a printer. In particular, in the case of impact printers, substantial electrical control powers are necessary for the printing, which is usually performed by passing current through a coil, and these electrical control powers are eventually transformed into heat and heat dissipation occurs. These power losses increase in proportion to the number of print elements and the control speed of the print elements. Consequently, it is necessary to monitor the temperature of the print head in order to avoid a thermal destruction of print-head device components. Upon reaching of a temperature critical for the print head, usually the print speed is reduced by a lowering of the operating frequency or the print head is temporarily switched off until the print-head temperature has cooled to a defined value, or a blower motor is turned on for providing cooling.

A temperature-sensitive sensor is used for the surveillance. The sensor transforms the print-head temperature into a corresponding measurement value. Based on space and cost reasons, one single sensor is employed and disposed centrally relative to the print head. The sensor determines the heat losses of all individual magnet coils resulting in a mixed average temperature value. The determined average temperature value depends in such cases on the temperature drop between the electromagnetic coils and the sensor, the time elapsed for the heat transport, the number of the electromagnetic coils controlled. Consequently the measurement value determination can be quite inaccurate relative to the purposes for which it is performed.

It has been proposed in the German Patent Application Laid Open DE-OS 2,618,224 to increase the number of print elements in the print head by at least one additional print element in a structure for increasing the lifetime of a print head for printing and writing apparatus, in particular for matrix printers, such that the printing power and capacity available is fully used only at rare times. However, in this case there occur problems relative to the frequency distribution of the feeding in of the current into the electromagnetic coil, associated with the print element, which cannot be determined in advance.

Another conventional structure taught in U.S. Pat. No. 4,496,824 controls a blower motor via a digital bus system, where initially the temperature, measured via a central thermistor, is determined via a voltage difference and an analog digital converter, and wherein the voltage difference is digitalized. This measurement is also relatively inaccurate based on the individual measurement result because the thermistor of the control circuit is mounted on the print-head surface. There is thus present a non-impact print head which itself generates heat during printing. Consequently, it is supposed that this structure does not carry an electromagnetic coil.

In the presence of a digitalized temperature measurement value, the switching-on and the switching-off of the print head of a printer can be performed according to a further teaching via special programs as referred to in the European Patent Application 0,176,732.

A particular problem is represented by a printer operating in graphic mode, where there can occur a particularly non-uniform and/or one-sided use load of the print head, for example because only one single print element is continuously operated In this case, there occur local overheating situations of the electromagnetic coil, whereby any kind of conventional temperature surveillance fails to provide adequate protection for the print head from thermal destruction.

SUMMARY OF THE INVENTION

1. Purposes of the Invention

It is an object of the present invention to provide a substantially faster, safer, more dependably, more reliably, and more accurately, operating device for a temperature surveillance of a print head or of a hammer block constructed with a plurality of electromagnetic coils.

It is a further object of the present invention to provide a method which allows a simple and accurate determination of temperatures at individual print elements in order to be able to limit the temperature of a print element to operation within a safe thermal range.

It is yet a further object of the present invention to provide a system for a temperature control of print elements in a print head, which is not associated with additional structural components to be placed in the area of the arrangement of the print elements.

These and other objects and advantages of the present invention will become evident from the description which follows.

2. Description of the Invention

The present invention provides for a device for a temperature surveillance of a print head or of a hammer block with a plurality of print impression elements. An electromagnetic coil is coordinated to each individual print impression element of said plurality of print impression elements. The electromagnetic coil furnishes mechanical power to an armature for actuating the respective one of the plurality of print impression elements. A switch circuit is connected to the electromagnetic coil, to an energizing power source for the coil, and to a constant current source for, in each case, electrically connecting the coil to the constant current source during an energizing pause of the coil. A comparator is connected to the electromagnetic coil and has an output for generating an output signal by comparing a signal corresponding to a coil voltage drop occurring at the electromagnetic coil during operation at a defined temperature limit with a temperature signal derived during actual operation. An intermediate data memory storage has an input connected to the output of the comparator. An output voltage of the comparator is accepted as a binary logic high or logic low signal at the intermediate data memory storage. The intermediate data memory storage has an output providing logic signals "logic high" or "logic low" to be employed as a control signal for effecting a temperature lowering in the print head or, respectively, allowing unchanged operation to continue.

A temperature-limiting final control element can be included for switching off a print head. The temperature-limiting final control element can be a means for lowering an operating frequency of the printing. The temperature-limiting final control element can be a means for a switch-on/switch-off control of a blower motor.

A temperature rise in the area of the electromagnetic coil, caused by a heat dissipation loss of the electromagnetic coil, can be determined and a switching signal derived therefrom can be used in a temperature-limiting final control element.

The print impression element can be a matrix pin.

A delay member can be connected to a second input of the intermediate data memory storage. A transfer of measurement pulses of the binary logic signal "logic high" or, respectively, "logic low", can be delayed by a time period corresponding to a value related to a measurement interval.

A matrix pin-driver circuit can be connected to the electromagnetic coil. An integrated circuit structure, wherein the comparator, the constant current source, the matrix pin-driver circuit, the intermediate data memory storage, and the delay member can be incorporated into the integrated circuit structure.

A temperature rise based on a power dissipation of the electromagnetic coil is determined by a comparison with a set standard temperature value, and a switching signal derived therefrom is employed either for the switching off of the print head or for a lowering of the operating frequency or for an on/off switching of a blower motor. The electromagnetic coil, coordinated to each print element, can be connected in each case to a constant current source during a current pause. A voltage drop at the electromagnetic coil generates a reference signal at a comparator, which reference signal determines the temperature limit. The reference voltage is transferred as a binary logic signal into an intermediate data memory storage. The logic signal serves as a control signal for a temperature lowering in the print head. This construction assures a substantially more effective surveillance of each individual print head and/or of each electromagnetic coil, respectively. In fact, a conclusion as to the respective coil temperature can be immediately performed by measuring the coil resistance as a function of the temperature. In the case that the measurement intervals are very short, it is possible to determine also a short-term local overheating. It is a particular advantage of the device of the present invention that the actual coil temperature can be captured without inertia independent of the inductivity or the self-inductivity, respectively, and that the surveillance of all coils occurs simultaneously. According to a particular feature of the invention, it is provided that a delay member is interposed into the transfer of the measurement pulses from the binary logic signal into the intermediate data memory storage, wherein the reaction time of the system corresponds to approximately a measurement interval. Based on this structure, only error-free measurement data can pass into the intermediate data memory storage such that initial error-associated measurements are eliminated.

According to a further feature of the invention, it is disclosed that the comparator, the constant current source, the data intermediate storage memory, and the delay member are included in an integrated circuit containing the pin-driver circuit. A possibly increased switching expenditure, associated with the individual measurement of each electromagnetic coil, is in no way disadvantageous, because during the new construction of an integrated circuit for a pin drive, the recited device components can be entered into the integration.

It is advantageous in the context of the description of the invention that the temperature surveillance of an electromagnetic coil be considered. This consideration repeats itself for each additional electromagnetic coil. The principle of the invention comprises the utilization of the temperature-dependent resistance of a technical coil. In case of a constant current, the voltage drop at the coil resistance is directly proportional to the resistance change of the coil induced by a temperature change according to Ohm's Law. For metallic materials, the resistance increases with temperature and this resistance increase with temperature is substantially linear over wide regions During the standard operation of a print head, there results however a continuous field change, which induces a voltage in the electromagnetic coil. This induction voltage is added like a vector to the voltage drop at the coil resistance and would distort and falsify the measurement value. Only if the magnetic field has stabilized, then the induced voltage is zero and the terminal voltage is proportional to the coil temperature.

The novel features which are considered as characteristic for the invention are set forth in the appended claims. The invention itself, however, both as to its construction and its method of operation, together with additional objects and advantages thereof, will be best understood from the following description of specific embodiments when read in connection with the accompanying drawing.

BRIEF DESCRIPTION OF THE DRAWING

In the accompanying drawing, in which are shown several of the various possible embodiments of the present invention.

DESCRIPTION OF INVENTION AND PREFERRED EMBODIMENT

Figure 1:
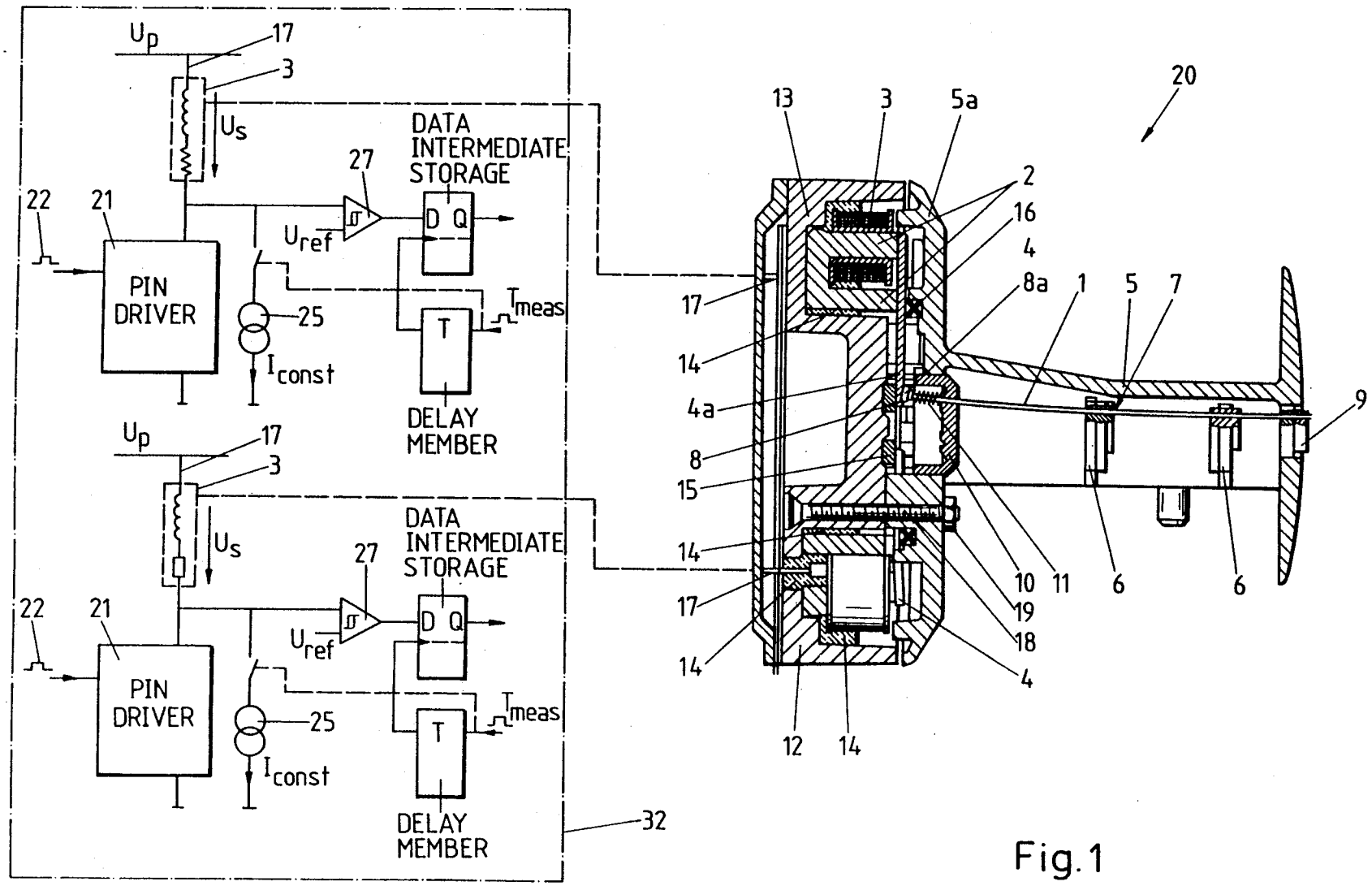
FIG. 1 is an in part sectional and an in part schematic view of a matrix pin print head with electromagnetic coils with a circuit device for temperature surveillance.
Figure 2:
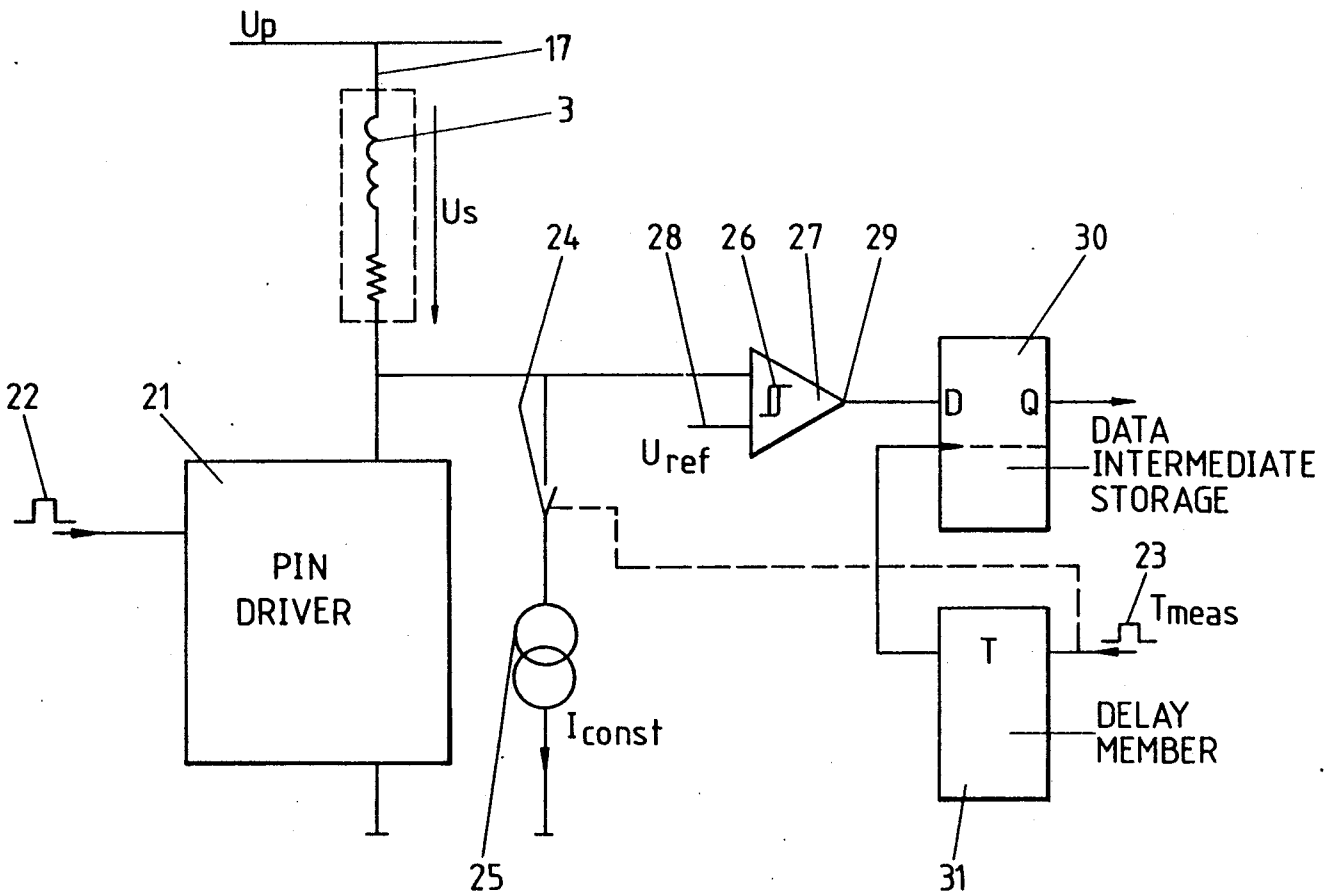
FIG. 2 is a schematic view of the device for temperature surveillance, at an enlarged scale, coordinated to each electromagnetic coil according to FIG. 1.

According with the present invention, there is provided a device for a temperature surveillance of a print head or of a hammer block based on an electromagnetic coil construction, in particular for serial matrix pin printers. A temperature rise, caused by a heat dissipation loss of the electromagnetic coil, is determined by comparison with a standard temperature, and a switching signal derived therefrom is either used for a switching off of a print head or for a lowering of an operating frequency or for a switch-on/switch-off control of a blower motor. The electromagnetic coil 3. coordinated to each print element 1, in each case is electrically connected during a current-passing pause to a constant current source ($U_p$) 25. A voltage drop ($U_s$) at the electromagnetic coil 3 generates a reference signal 26 at a comparator 27, determining the temperature limit. The reference voltage ($U_{ref}$) 28 is accepted as a binary logic high or logic low signal in an intermediate data memory storage 30. The logic signal "logic high" or "logic low", serves as a control signal for a temperature lowering in the print head 20.

The transfer of the measurement pulses 23 of the binary logic signal "logic high" or, respectively, "logic low", can include a delay member 31 disposed in the intermediate data memory storage 30. The reaction time of the system can correspond approximately to a measurement interval ($T_{meas}$).

The comparator 27, the constant current source ($U_p$) 25, the data intermediate storage memory 30, and the delay member 31 can be incorporated into an integrated circuit 32 including also a pin-driver circuit 21.

Each print impression element 1 can be associated with a clapper armature construction. Each print impression element 1 can include several component parts. An inner magnet yoke arm can form together with the outer magnet yoke arm a magnet yoke arm pair 2. Case guide means, represented by bores 7, can be provided for a clapper armature 4. A print pin, represented by print element 1, can have a print pin head 8*a*. A pin engagement position 8 can be formed between the print pin head 8*a* and the clapper armature 4. The magnet yoke arm pair 2 can be directed toward the pin engagement position 8.

The illustrated matrix pin print head corresponds in the exemplified embodiment to the so-called clapper armature construction, illustrated in FIG. 1, and includes, for example, 9, 12, 18, or 24 print elements 1. A magnetic yoke arm pair 2, an electromagnetic coil 3, and a clapper armature 4 are coordinated to each print element 1. The electromagnetic coil 3 is placed and plugged onto a radially outwardly disposed magnetic yoke arm. Pin head arrays of 9, 12, 18, or 24 of such systems can be present.

The print elements 1 are guided in a print-pin guide casing 5 by way of individual guide walls 6. The bores 7 of the guide walls 6 define the arcuate course from a pin-engagement position 8 of a print pin head 8*a* and the clapper armature 4 to a mouth piece 9. The mouth piece 9 rests near the recording material carrier disposed on the print counter support at a distance of a print element stroke versus a print head support, not illustrated.

The print-pin guide casing 5 forms in the region of the clapper armature 4 a shell 5*a* corresponding to the outer diameter of the matrix pin print head 20. A guide bush 10 is disposed in the center of the shell 5*a*. The guide bush 10 forms a counter support for a compression spring 11, which is coordinated to each print element 1.

A rear casing 12, receiving the systems, is produced of plastic or aluminum or of other magnetically non-conducting materials. The rear casing 12 centers a single-piece electromagnetic coil support 13, made out of sinter material or fine-cast material. The single-piece electromagnetic coil support 13, furnished of high precision and of high surface quality, rests, magnetically insulated by the electrically non-conductive filling materials 14, inside of the rear casing 12. The rear casing 12, made of aluminum, is in addition furnished with a centered, thermally stable, adhesively attached damping disk 15. The radially inner armature arms 4*a* rest in a base position or in a rest position on the damping disk 15.

The clapper armatures 4 are fixed by this damping disk 15 with the radially inner armature arms 4*a*. The clapper armatures 4 are centrally tiltably supported by an elastic damping disk 16, having a quadrangular cross-section, and disposed coaxial to the arrangement of armatures, as well as by the radially inner, oppositely disposed magnet yoke arm of the magnet yoke arm pair.

The clapper armature 4 performs swivelling motions, in order to furnish a stroke motion to the print elements 1. Such stroke motions (advance and return stroke amount to about 0.3 mm) are performed with a frequency of from about 2,000 to 3,000 Hz.

Connection lines 17 are led from the electromagnetic coils 3 (FIG. 1) through the filling material 14 to a conductor board, not illustrated in detail. The shell 5*a* and the rear casing 12 are connected to each other by way of screws 18 and by way of threaded nuts 19.

A particular device for the temperature surveillance of print head 20 is coordinated to each electromagnetic coil 3.

Based on a switching signal generated by the device, this particular device can effect either a switching off of the print head 20 or a lowering of the operating frequency or a switching-on or switching-off of the control of a blower motor.

The device comprises, in each case, the following circuit elements, which perform the recited functions. Each electromagnetic coil 3 is fed with current pulses 22 for the actuation of a print element 1 via a conventional pin-driver circuit 21. Such a pin-driver circuit is described, for example, in the German Patent 3,151,242. This current application to the electromagnetic coil 3 causes a power dissipation and waste heat, which heats up the print head 20 and can cause, in particular, an overall heating of the electromagnetic coil 3 or, respectively, of individual windings of the copper wire up to a destruction of the copper wire.

As soon as a print element 1 is not actuated, a current pause occurs. A switch circuit 24 is closed by a measurement pulse 23 and the electromagnetic coil 3 is connected to a constant current source $U_p$, 25. This current from the constant current source $U_p$, 25 causes a coil voltage drop $U_s$ at the electromagnetic coil 3 and a reference signal 26 is generated at a comparator 27 from the voltage drop $U_s$. The comparator 27 compares the voltage difference, primary voltage source ($U_p$) minus coil voltage drop ($U_s$) equal to a measurement voltage ($U_p - U_s$) to a reference voltage 28 ($U_{ref}$) at the comparator 27. Depending on whether the measurement voltage is disposed above or below the reference voltage, there is present at the output 29 of the comparator 27 a "logic high potential" or a "logic low potential." The reference voltage 28 ($U_{ref}$) corresponds to the temperature value, where an activation and action of the device is required The binary signal of the logic high potential/logic low potential is placed into a intermediate data memory storage 30. Because of the energy potential of the induction or, respectively, self-induction, present in the electromagnetic coil 3 upon a last current pulse 22, the measurement pulse 23 is passed on later via a delay member 31 into the intermediate data memory storage 30 in order to avoid a falsification of the measurement result. The binary data are stabilized before a storage occurs such that erroneous values are avoided The measurement process is terminated upon receiving of the data information into the data intermediate storage 30. Depending on the measurement result, it is determined in each case whether the print head 20, including all or individual electromagnetic coils 3 are switched off or if a lowering of the operating frequency should occur or if a blower motor is to be turned on.

The comparator 27, the constant current source 25, which can also be furnished formed as discrete components, the intermediate data memory storage 30 and the delay member 31 and the pin-driver circuit 21 can each form a part of an integrated switching circuit 32.

A method for protecting print elements against overheating comprises the following steps. An electromagnetic coil 3 is energized with power from an electric power source. The electromagnetic coil 3 is connected to the power source and a magnetic field is built up in the electromagnetic coil 3. The electromagnetic coil 3 is coordinated to each individual print element of a plurality of print impression elements. Mechanical power is furnished to an armature 4 for actuating one of the plurality of print impression elements 1 with a magnetic field in said electromagnetic coil 3. The energizing power is switched off at the electromagnetic coil 3 with a switch circuit connected to the electromagnetic coil 3, to the energizing power source for the coil 3, and to the constant current source ($U_p$) 25, and providing for an energizing pause of the electromagnetic coil 3. The coil 3 is electrically connected to the constant current source 25 during an energizing pause of the coil 3. A comparator 27 is connected to the electromagnetic coil 3 and has an output for generating an output signal. A signal corresponding to a coil voltage drop ($U_s$) occurring at the electromagnetic coil 3 during operation at a defined temperature limit is compared with a temperature signal derived during actual operation. A comparator output signal is generated distinguishing temperatures below and above a temperature limit sensed near a print impression element 1. The comparator output signal is accepted in an intermediate data memory storage 30 connected to an output 29 of the comparator 27. A temperature lowering in the print head 20 is effected where the comparator output signal is associated with an overheated print impression element 1.

An overheating in the area of the electromagnetic coil 3, caused by a heat dissipation loss of the electromagnetic coil can be determined. A transfer of measurement pulses of the binary logic signal "logic high" or, respectively, "logic low", can be delayed by a time period corresponding to a value related to a measurement interval in a delay member 31 connected to a second input of the intermediate data memory storage 30.

A transfer of the output signal of the comparator 27 in the intermediate data memory storage 30 by a time period corresponding to a value related to a measurement interval can be delayed with a delay member 31 connected to the intermediate data memory storage.

A clapper armature 4 can be engaged with a magnetic field influenced by the electromagnetic coil current. A clapper armature 4 can be guided with case guide means, represented by bores 7, for the clapper armature 4. A print pin, represented by a print element 1, can have a print pin head 8*a* with the clapper armature 4. A pin engagement position 8 can be formed between the print pin head 8*a* and the clapper armature 4. A magnet yoke arm pair 2 can be directed toward the pin engagement position 8.

It will be understood that each of the elements described above, or two or more together, may also find a useful application in other types of devices for temperature control of a print head or a hammer block differing from the types described above.

While the invention has been illustrated and described as embodied in the context of a device for the temperature control of a print head or of a hammer block including an electromagnetic coil, it is not intended to be limited to the details shown, since various modifications and structural changes may be made without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention.

What is claimed as new and desired to be protected by Letters Patent is set forth in the appended claims:

1. A method for protecting print elements against overheating comprising providing a constant current source ($U_p$, 25); energizing an electromagnetic coil (3) with power from an electric power source, wherein the electromagnetic coil (3) is connected to the power source, and building up a magnetic field in the electromagnetic coil (3), wherein the electromagnetic coil (3) is coordinated to each individual print element (1) of a plurality of print impression elements;

furnishing mechanical power to an armature (4) for actuating one of the plurality of print impression elements (1) with a magnetic field in said electromagnetic coil (3); switching the energizing power off at the electromagnetic coil (3) with a switch circuit connected to the electromagnetic coil (3), to the energizing power source for the coil, and to the constant current source ($U_p$, 25), and providing for an energizing pause of the electromagnetic coil (3);

electrically connecting the coil (3) to the constant current source (25) during an energizing pause of the coil; connecting a comparator (27), having an output, to the electromagnetic coil (3) generating an output signal;

comparing a signal corresponding to a coil voltage drop ($U_s$) occurring at the electromagnetic coil (3) during operation at a defined temperature limit with a temperature signal derived during actual operation;

generating a comparator output signal distinguishing temperatures below and above a temperature limit sensed near a print impression element (1);

accepting the comparator output signal in an intermediate data memory storage (30) connected to an output (29) of the comparator (27);

effecting a temperature lowering in the print head (20) where the comparator output signal is associated with an overheated print impression element (1).

2. The method for protecting print elements against overheating according to claim 1, further comprising determining an overheating in the area of the electromagnetic coil (3), caused by a heat dissipation loss of the electromagnetic coil (3); and delaying a transfer of measurement pulses of the binary logic signal "logic high" or, respectively, "logic low", by a time period corresponding to a value related to a measurement interval ($T_{meas}$) in a delay member (31) connected to a second input of the intermediate data memory storage (30).

3. The method for protecting print elements against overheating according to claim 1, further comprising delaying transfer of the output signal of the comparator (27) in the intermediate data memory storage (30) by a time period corresponding to a value related to a measurement interval ($T_{meas}$) with a delay member (31) connected to the intermediate data memory storage (30).

4. The method for protecting print elements against overheating according to claim 1, further comprising engaging a clapper armature (4) with a magnetic field influenced by the electromagnetic coil current;

guiding a clapper armature (4) with case guide means for the clapper armature (4);

shooting a print pin, having a print pin head (8*a*) with the clapper armature (4), wherein a pin engagement position (8) is formed between the print pin head (8*a*) and the clapper armature (4), wherein a magnet yoke arm pair (2) is directed toward the pin engagement position (8).

5. A device for a temperature surveillance of a print head or of a hammer block comprising a plurality of print impression elements;

an electromagnetic coil coordinated to each individual print impression element of said plurality of print impression elements and said electromagnetic coil furnishing mechanical power to an armature for actuating the respective one of the plurality of print impression elements;

a constant current source;

an energizing power source for said electromagnetic coil;

a switch circuit connected to the electromagnetic coil, to the energizing power source for the coil, and to the constant current source for, in each case, electrically connecting the coil to the constant current source during an energizing pause of the coil;

a comparator connected to the electromagnetic coil and having an output for generating an output signal by comparing a signal corresponding to a coil voltage drop occurring at the electromagnetic coil during operation at a defined temperature limit with a temperature signal derived during actual operation;

an intermediate data memory storage having an input connected to the output of the comparator, wherein an output voltage of the comparator is accepted as a binary logic high or logic low signal at the intermediate data memory storage, and wherein the intermediate data memory storage has an output providing logic signals "logic high" or "logic low" to be employed as a control signal for effecting a temperature lowering in the print head or, respectively, allowing unchanged operation to continue.

6. The device for a temperature surveillance according to claim 1, further comprising a temperature-limiting final control element.

7. The device for a temperature surveillance according to claim 6, wherein the temperature-limiting final control element is a means for switching off a print head.

8. The device for a temperature surveillance according to claim 6, wherein the temperature-limiting final control element is a means for lowering an operating frequency of the printing.

9. The device for a temperature surveillance according to claim 6, wherein the temperature-limiting final control element is a means for a switch-on/switch-off control of a blower motor.

10. The device for a temperature surveillance according to claim 5, wherein a temperature rise in the area of the electromagnetic coil, caused by a heat dissipation loss of the electromagnetic coil, is determined and a switching signal derived therefrom is used in a temperature-limiting final control element.

11. The device for a temperature surveillance according to claim 5, wherein the print impression element is a matrix pin.

12. The device for a temperature surveillance according to claim 5, further comprising a delay member connected to a second input of the intermediate data memory storage, wherein a transfer of measurement pulses of the binary logic signal "logic high" or, respectively, "logic low", is delayed by a time period corresponding to a value related to a measurement interval.

13. The device for a temperature surveillance according to claim 12, further comprising a matrix pin-driver circuit connected to the electromagnetic coil.

14. The device for a temperature surveillance according to claim 13, further comprising an integrated circuit structure, wherein the comparator, the constant current source, the matrix pin-driver circuit, the intermediate data memory storage, and the delay member are incorporated into the integrated circuit structure.

15. A device for printing employing print elements protected against overheating, comprising a plurality of print impression elements;

an energizing power source for said electromagnetic coil;

an electromagnetic coil coordinated to each individual print impression element of said plurality of print impression elements and connected to the power source, and said electromagnetic coil furnishing mechanical power to an armature for actuating one of the print impression elements;

a constant current source;

a switch circuit connected to the electromagnetic coil, to the energizing power source for the coil, and to the constant current source for in each case electrically connecting the coil to the current of the constant current source during an energizing pause of the coil;

a comparator connected to the electromagnetic coil and having an output for generating an output signal by comparing a signal corresponding to a coil voltage drop occurring at the electromagnetic coil during operation, at a defined temperature limit with a temperature signal derived during actual operation;

an intermediate data memory storage having an input connected to the output of the comparator, wherein an output voltage of the comparator is accepted as a binary logic high or logic low signal at the intermediate data memory storage, and wherein the intermediate data memory storage has an output providing logic signals "logic high" or "logic low" to be employed as a control signal for effecting a temperature lowering in the print head or, respectively, allowing unchanged operation to continue.

16. The device for printing employing print elements according to claim 15, further comprising a temperature-limiting final control element;

wherein a temperature rise in the area of the electromagnetic coil, caused by a heat dissipation loss of the electromagnetic coil, is determined and a switching signal derived therefrom is used in a temperature-limiting final control element;

a delay member connected to a second input of the intermediate data memory storage, wherein a transfer of measurement pulses of the binary logic signal "logic high" or, respectively, "logic low", is delayed by a time period corresponding to a value related to a measurement interval;

an integrated circuit structure, wherein the comparator, the constant current source, the matrix pin-driver circuit, the intermediate data memory storage, and the delay member are incorporated into the integrated circuit structure.

17. The device for printing employing print elements according to claim 15, wherein each print impression element (1) is associated with a clapper armature construction, and further comprising in association with each print impression element (1):

an outer magnet yoke arm;

an inner magnet yoke arm forming together with the outer magnet yoke arm a magnet yoke arm pair (2);

a clapper armature (4);

case guide means for the clapper armature (4);

a print pin having a print pin head (8*a*), wherein a pin engagement position (8) is formed between the print pin head (8*a*) and the clapper armature (4), and wherein the magnet yoke arm pair (2) is directed toward the pin engagement position (8).

18. A device for a temperature surveillance of a print head or of a hammer block based on an electromagnetic coil construction, in particular for serial matrix pin printers, wherein a temperature rise, caused by a heat dissipation loss of the electromagnetic coil, is determined by comparison with a standard temperature, and a switching signal derived therefrom is either used for a switching off of a print head or for a lowering of an operating frequency or for a switch-on/switch-off control of a blower motor, wherein the electromagnetic coil (3), coordinated to each print element (1), in each case is electrically connected during a current-passing pause to a constant current source ($U_p$) (25), wherein a voltage drop ($U_s$) at the electromagnetic coil (3) generates a reference signal (26) at a comparator (27), determining the temperature limit, wherein the reference voltage ($U_{ref}$) (28) is accepted as a binary logic high or logic low signal in an intermediate data memory storage (30), and wherein the logic signal "logic high" or "logic low", serves as a control signal for a temperature lowering in the print head (20).

19. The device according to claim 18, wherein the transfer of the measurement pulses (23) of the binary logic signal "logic high" or, respectively, "logic low", includes a delay member (31) disposed in the intermediate data memory storage (30), wherein the reaction time of the system corresponds approximately to a measurement interval ($T_{meas}$).

20. The device according to claim 18, wherein the comparator (27), the constant current source (25), the data intermediate storage memory (30), and the delay member (31) are incorporated into an integrated circuit (32) including also a pin-driver circuit (21).

* * * * *